US010839772B2

(12) United States Patent
Hyun

(10) Patent No.: US 10,839,772 B2
(45) Date of Patent: Nov. 17, 2020

(54) DISPLAY APPARATUS, METHOD OF COMPENSATING IMAGE OF THE SAME AND DISPLAY IMAGE COMPENSATING SYSTEM HAVING THE SAME

(71) Applicant: Samsung Display Co., Ltd., Yongin-si (KR)

(72) Inventor: Chang Ho Hyun, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/367,195

(22) Filed: Mar. 27, 2019

(65) Prior Publication Data

US 2019/0304403 A1 Oct. 3, 2019

(30) Foreign Application Priority Data

Apr. 3, 2018 (KR) ..... 10-2018-0038883

(51) Int. Cl.
*G09G 5/10* (2006.01)
*G09G 5/02* (2006.01)

(52) U.S. Cl.
CPC ..... *G09G 5/10* (2013.01); *G09G 5/02* (2013.01); *G09G 2310/027* (2013.01); *G09G 2320/0242* (2013.01); *G09G 2320/0276* (2013.01); *G09G 2360/145* (2013.01); *G09G 2360/16* (2013.01)

(58) Field of Classification Search
CPC .... G09G 5/10; G09G 5/02; G09G 2320/0276; G09G 2320/0673; G09G 3/3406; G09G 3/3413
See application file for complete search history.

(56) References Cited

U.S. PATENT DOCUMENTS 8,797,346 B2 8/2014 Park et al.
9,892,682 B2 2/2018 Pyo
10,249,231 B2 * 4/2019 Cha ..... G09G 3/2092
10,395,572 B2 * 8/2019 Jee ..... G09G 3/20
(Continued)

FOREIGN PATENT DOCUMENTS

KR 10-2013-0051751 5/2013
KR 10-2016-0148128 12/2016
KR 10-2017-0070299 6/2017

OTHER PUBLICATIONS

Y. Bard, "Nonlinear Parameter Estimation", Academic Press, 1974.
(Continued)

*Primary Examiner* — Sardis F Azongha
(74) *Attorney, Agent, or Firm* — H.C. Park & Associates, PLC

(57) ABSTRACT

A display apparatus includes a display panel, a voltage compensator, and a data driver. The display panel is configured to display an image. The voltage compensator is configured to compensate a plurality of normal grayscale gamma voltages corresponding to a plurality of grayscale values equal to or greater than a reference voltage based on a plurality of measured luminances for the plurality of the grayscale values, and to determine a low grayscale gamma voltage less than the reference voltage based on the measured luminances. The data driver is configured to generate a data voltage based on the normal grayscale gamma voltage and the low grayscale gamma voltage and to output the data voltage to the display panel.

20 Claims, 7 Drawing Sheets

(56) References Cited

U.S. PATENT DOCUMENTS

| | | | | |
|---|---|---|---|---|
| 10,446,097 | B2 * | 10/2019 | Zhang | G09G 3/006 |
| 2012/0206504 | A1 * | 8/2012 | Ha | G09G 5/10 345/690 |
| 2015/0287350 | A1 * | 10/2015 | Jun | G09G 3/006 345/690 |
| 2017/0169758 | A1 | 6/2017 | Park | |
| 2017/0249890 | A1 * | 8/2017 | Yoo | G09G 3/2074 |
| 2019/0066628 | A1 * | 2/2019 | Wang | G09G 3/006 |
| 2020/0013348 | A1 * | 1/2020 | Lee | G09G 3/3406 |

OTHER PUBLICATIONS

Lourakis, Manoils I. A., "A Brief Description of the Levenberg-Marquardt Algorithm Implemened by levmar", Institute of Computer Science Foundation for Research and Technology, Feb. 11, 2005.

Paul Fredrick Mondragon, "A Comparison of Nonlinear Regression Codes", New Mexico Institute of Mining and Technology, May 2003.

* cited by examiner

DISPLAY APPARATUS, METHOD OF COMPENSATING IMAGE OF THE SAME AND DISPLAY IMAGE COMPENSATING SYSTEM HAVING THE SAME

CROSS REFERENCE TO RELATED APPLICATION

This application claims priority from and the benefit of Korean Patent Application No. 10-2018-0038883, filed on Apr. 3, 2018, which is hereby incorporated by reference for all purposes as if fully set forth herein.

BACKGROUND

Field

Exemplary embodiments of the present inventive concept relate to a display apparatus, a method of compensating image of the display apparatus, and a display image compensating system including the display apparatus. More specifically, exemplary embodiments of the present inventive concept relate to a display apparatus enhancing a display quality of a low grayscale value image and enhancing productivity of the display apparatus, a method of compensating image of the display apparatus and a display image compensating system including the display apparatus.

Discussion of the Background

Multi time programming is a method of storing a driving voltage or timing information to an internal memory to enhance a display quality of a display image and driving characteristics.

Particularly, when a fixed representative gamma voltage is used to compensate a low grayscale value area of a display image, the low grayscale value area of the display image may not be compensated enough so that the display image may become greenish.

Measuring luminance of the low grayscale value area of the display image by a measuring apparatus may not be accurate. To increase the accuracy of the measurement, the measuring time may increase. Due to reliability of the measuring apparatus and takt time, compensation of the low grayscale value area may not be accurate. Accordingly, when the fixed representative gamma voltage is used to compensate the low grayscale value area of the display image, it is difficult to accurately compensate the low grayscale value area.

The above information disclosed in this Background section is only for understanding of the background of the inventive concepts, and, therefore, it may contain information that does not constitute prior art

SUMMARY

Exemplary embodiments of the present inventive concept provide a display apparatus capable of enhancing a display quality of a low grayscale value image.

Exemplary embodiments of the present inventive concept also provide a method of compensating an image of the display apparatus.

Exemplary embodiments of the present inventive concept also provide a display image compensating system including the display apparatus.

Additional features of the inventive concepts will be set forth in the description which follows, and in part will be apparent from the description, or may be learned by practice of the inventive concepts.

In an exemplary embodiment of a display apparatus according to the present inventive concept, the display apparatus includes a display panel, a voltage compensator, and a data driver. The display panel is configured to display an image. The voltage compensator is configured to compensate a plurality of normal grayscale gamma voltages corresponding to a plurality of grayscale values equal to or greater than a reference voltage based on a plurality of measured luminances for the plurality of the grayscale values, and to determine a low grayscale gamma voltage less than the reference voltage based on the measured luminances. The data driver is configured to generate a data voltage based on the normal grayscale gamma voltage and the low grayscale gamma voltage and to output the data voltage to the display panel.

In an exemplary embodiment, the voltage compensator may be configured to determine a measured voltage corresponding to the measured luminance. The voltage compensator may be configured to determine a grayscale-voltage curve based on the measured voltage, the grayscale-voltage curve being represented as a function of $y=ax^c+b$. The voltage compensator may be configured to determine variables a, b and c based on the measured voltages for the plurality of the grayscale values to determine the low grayscale gamma voltage.

In an exemplary embodiment, the voltage compensator may be configured to determine the variables a, b and c based on the measured voltages for least four grayscale values among the plurality of the grayscale values.

In an exemplary embodiment, the determined low grayscale gamma voltage may be a white low grayscale gamma voltage. The voltage compensator may be configured to determine a red low grayscale gamma voltage, a green low grayscale gamma voltage and a blue low grayscale gamma voltage based on the white low grayscale gamma voltage.

In an exemplary embodiment, the voltage compensator may include a color compensator configured to apply a color compensation to the low grayscale gamma voltage when the image displayed on the display panel using the low grayscale gamma voltage exceeds a target range of color coordinates.

In an exemplary embodiment, the color compensator may be configured to generate a color compensating value using a terminal value of target color coordinates and a terminal value of measured color coordinates.

In an exemplary embodiment, the color compensator may be configured to generate an index value of the measured color coordinates. The index value may include a red index value, a green index value and a blue index value. When the measured color coordinates are x and y, the luminance of the image is L, the red index value of the measured color coordinates is IR, the green index value of the measured color coordinates is IG, the blue index value of the measured color coordinates is IB and converting constants are C11, C12, C13, C21, C22, C23, C31, C32 and C33, the red index value and the green index value and the blue index value may be represented as $$\begin{pmatrix} IR \\ IG \\ IB \end{pmatrix} = \begin{pmatrix} C11 & C12 & C13 \\ C21 & C22 & C23 \\ C31 & C32 & C33 \end{pmatrix} \begin{pmatrix} x * L/y \\ L \\ -(L(x+y-1))/y \end{pmatrix}.$$

In an exemplary embodiment, when the terminal value of the measured color coordinates is T, the index value of the measured color coordinates is I and a gamma value of the display panel is γ, correlation between the terminal value of the measured color coordinates and the index value of the measured color coordinates may be defined by $$T=1.055\times\sqrt[\gamma]{I}-0.055.$$

In an exemplary embodiment of a display apparatus according to the present inventive concept, the display apparatus includes a display panel, a voltage compensator and a data driver. The display panel is configured to display an image. The voltage compensator is configured to compensate a plurality of gamma voltages corresponding to a plurality of grayscale values based on a plurality of measured luminances for the plurality of the grayscale values. The data driver is configured to generate a data voltage based on the gamma voltage and to output the data voltage to the display panel. The voltage compensator is configured to generate a color compensating value using a terminal value of target color coordinates and a terminal value of measured color coordinates when the image displayed on the display panel exceeds a target range of color coordinates.

In an exemplary embodiment, the voltage compensator may be configured to generate an index value of the measured color coordinates. The index value may include a red index value, a green index value and a blue index value. When the measured color coordinates are x and y, the luminance of the image is L, the red index value of the measured color coordinates is IR, the green index value of the measured color coordinates is IG, the blue index value of the measured color coordinates is IB and converting constants are C11, C12, C13, C21, C22, C23, C31, C32 and C33, the red index value and the green index value and the blue index value may be represented as $$\begin{pmatrix} IR \\ IG \\ IB \end{pmatrix} = \begin{pmatrix} C11 & C12 & C13 \\ C21 & C22 & C23 \\ C31 & C32 & C33 \end{pmatrix} \begin{pmatrix} x*L/y \\ L \\ -(L(x+y-1))/y \end{pmatrix}.$$

In an exemplary embodiment, when the terminal value of the measured color coordinates is T, the index value of the measured color coordinates is I and a gamma value of the display panel is γ, correlation between the terminal value of the measured color coordinates and the index value of the measured color coordinates may be defined by $$T=1.055\times\sqrt[\gamma]{I}-0.055$$

In an exemplary embodiment of a method of compensating an image of a display apparatus according to the present inventive concept, the method includes compensating a plurality of normal grayscale gamma voltages corresponding to a plurality of grayscale values equal to or greater than a reference voltage based on a plurality of measured luminances for the plurality of the grayscale values, determining a low grayscale gamma voltage less than the reference voltage based on the measured luminances and generating a data voltage based on the normal grayscale gamma voltage and the low grayscale gamma voltage.

In an exemplary embodiment, the determining the low grayscale gamma voltage may include determining a measured voltage corresponding to the measured luminance, determining a grayscale-voltage curve based on the measured voltage, the grayscale-voltage curve being represented as a function of $y=ax^c+b$ and determining variables a, b and c based on the measured voltages for the plurality of the grayscale values.

In an exemplary embodiment, the variables a, b and c may be determined based on the measured voltages for least four grayscale values among the plurality of the grayscale values.

In an exemplary embodiment, the determined low grayscale gamma voltage may be a white low grayscale gamma voltage. The method may further include determining a red low grayscale gamma voltage, a green low grayscale gamma voltage and a blue low grayscale gamma voltage based on the white low grayscale gamma voltage.

In an exemplary embodiment, the method may further include applying a color compensation to the low grayscale gamma voltage when the image displayed on the display panel using the low grayscale gamma voltage exceeds a target range of color coordinates.

In an exemplary embodiment, the applying the color compensation to the low grayscale gamma voltage may include generating a color compensating value using a terminal value of target color coordinates and a terminal value of measured color coordinates.

In an exemplary embodiment, the applying the color compensation to the low grayscale gamma voltage may further include generating an index value of the measured color coordinates, the index value including a red index value, a green index value and a blue index value. When the measured color coordinates are x and y, the luminance of the image is L, the red index value of the measured color coordinates is IR, the green index value of the measured color coordinates is IG, the blue index value of the measured color coordinates is IB and converting constants are C11, C12, C13, C21, C22, C23, C31, C32 and C33, the red index value and the green index value and the blue index value may be represented as $$\begin{pmatrix} IR \\ IG \\ IB \end{pmatrix} = \begin{pmatrix} C11 & C12 & C13 \\ C21 & C22 & C23 \\ C31 & C32 & C33 \end{pmatrix} \begin{pmatrix} x*L/y \\ L \\ -(L(x+y-1))/y \end{pmatrix}.$$

In an exemplary embodiment of a display image compensating system according to the present inventive concept, the display image compensating system includes a display panel, a sensor, a voltage compensator, a data driver and a sensor. The display panel is configured to display an image. The sensor is configured to measure a luminance of the image of the display panel. The voltage compensator is configured to compensate a plurality of normal grayscale gamma voltages corresponding to a plurality of grayscale values equal to or greater than a reference voltage based on a plurality of the measured luminances for the plurality of the grayscale values and to determine a low grayscale gamma voltage less than the reference voltage based on the measured luminances. The data driver is configured to generate a data voltage based on the normal grayscale gamma voltage and the low grayscale gamma voltage and to output the data voltage to the display panel. The sensor driver is configured to drive the sensor and to transmit the measured luminance by the sensor to the voltage compensator.

According to an exemplary embodiments of the display apparatus, a method of an image of the display apparatus, and a display image compensating system including the display apparatus, a low grayscale gamma voltage corresponding to a grayscale less than a threshold grayscale is expected using measured luminance values for a plurality of grayscale values greater than the threshold grayscale. In addition, when the image displayed on the display panel using the low grayscale gamma voltage exceeds a target range of color coordinates, a color compensation is applied to the low grayscale gamma voltage. Thus, the display quality of the low grayscale image may be enhanced.

In addition, the time required to determine the low grayscale gamma voltage may be dramatically decreased so that the productivity of the display apparatus may be enhanced.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
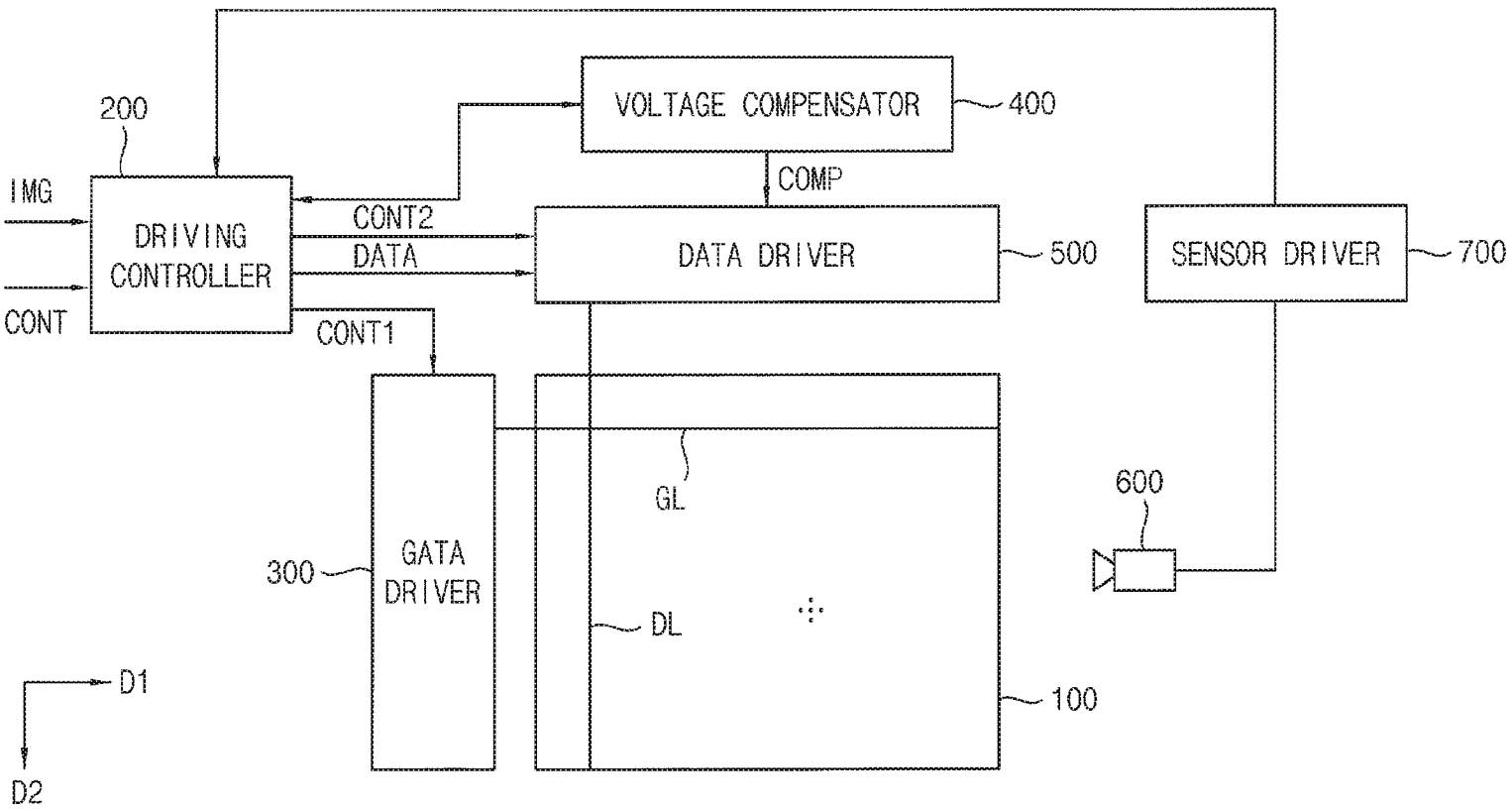
FIG. 1 is a block diagram illustrating a display image compensating system according to an exemplary embodiment of the present inventive concept.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram illustrating a display image compensating system according to an exemplary embodiment of the present inventive concept.

Referring to FIG. 1, the display image compensating system includes a display panel 100, a display panel driver, a sensor 600, and a sensor driver 700. The display panel driver includes a driving controller 200, a gate driver 300, a voltage compensator 400, and a data driver 500.

The display panel 100 displays an image. The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

The driving controller 200 receives the input image data IMG and the input control signal CONT from an external apparatus. For example, the input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 may receive a measured luminance or a measured voltage from the sensor driver 700. The driving controller 200 may output the measured luminance or the measured voltage to the voltage compensator 400.

The gate driver 300 generates gate signals driving the gate lines GL in response to the first control signal CONT1 received from the driving controller 200. The gate driver 300 sequentially outputs the gate signals to the gate lines GL.

In the present exemplary embodiment, the gate driver 300 may be a gate driving circuit integrated on the display panel 100.

The voltage compensator 400 compensates a gamma voltage and output the compensated gamma voltage COMP to the data driver 500. The gamma voltage has a value corresponding to a level of the data signal DATA. The gamma voltage may be compensated according to the measured luminance which is measured by the sensor 600.

For example, the voltage compensator 400 may be disposed in the driving controller 200 or in the data driver 500.

The data driver 500 receives the second control signal CONT2 and the data signal DATA from the driving controller 200, and receives the compensated gamma voltage COMP from the voltage compensator 400. The data driver 500 converts the data signal DATA into data voltages having an analog type using the compensated gamma voltage COMP. The data driver 500 outputs the data voltages to the data lines DL. Alternatively, the data driver 500 may receive a compensated data signal from the voltage compensator 400 and may output the data voltage based on the compensated data signal.

In an exemplary embodiment, the driving controller 200 and the data driver 500 may be formed as a single integrated chip.

The sensor 600 may be a luminance measure measuring the luminance of the image displayed on the display panel 100.

The sensor driver 700 drives the sensor 600 and outputs the measured luminance which is measured by the sensor 600 to the driving controller 200. The measured luminance outputted from the sensor driver 700 may be transmitted to the voltage compensator 400 via the driving controller 200.

For example, the sensor 600 and the sensor driver 700 may be independent elements from the display apparatus. The sensor 600 and the sensor driver 700 may be disposed outside of the display apparatus. Alternatively, the sensor 600 and the sensor driver 700 may be disposed in the display apparatus. When the sensor 600 and the sensor driver 700 are disposed in the display apparatus, the gamma voltage may be compensated in real time. When the sensor 600 and the sensor driver 700 are disposed in the display apparatus, differences of color coordinates due to differences of deterioration of color over time of the display apparatus may be compensated.

Figure 2:
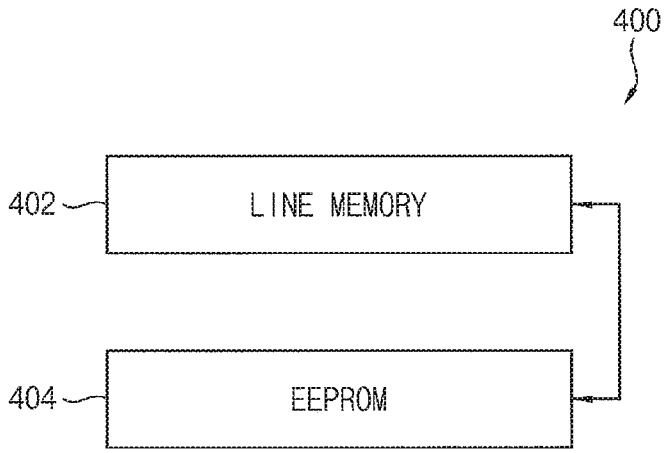
FIG. 2 is a memory block diagram illustrating a voltage compensator of FIG. 1.

FIG. 2 is a memory block diagram illustrating the voltage compensator 400 of FIG. 1.

Referring to FIGS. 1 and 2, the voltage compensator 400 may include a line memory 402 and an EEPROM (electrically erasable programmable read-only memory) 404.

The data signal DATA which is an object of compensation may be temporarily stored in the line memory 402. Gamma compensating values may be stored in the EEPROM 404. The gamma compensating value or the compensated gamma voltage according to the data signal DATA inputted to the line memory 402 may be outputted to the data driver 500. For example, the voltage compensator 400 may be integrally formed with the driving controller 200 or the data driver 500. For example, the driving controller 200, the voltage compensator 400, and the data driver 500 may be integrally formed.

Figure 3:
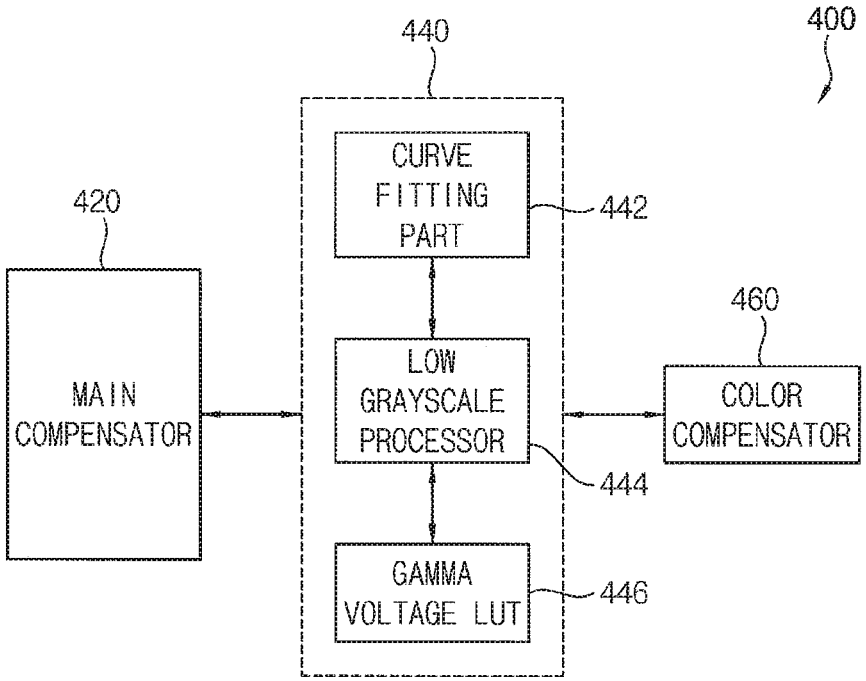
FIG. 3 is a system block diagram illustrating the voltage compensator of FIG. 1.
Figure 4:
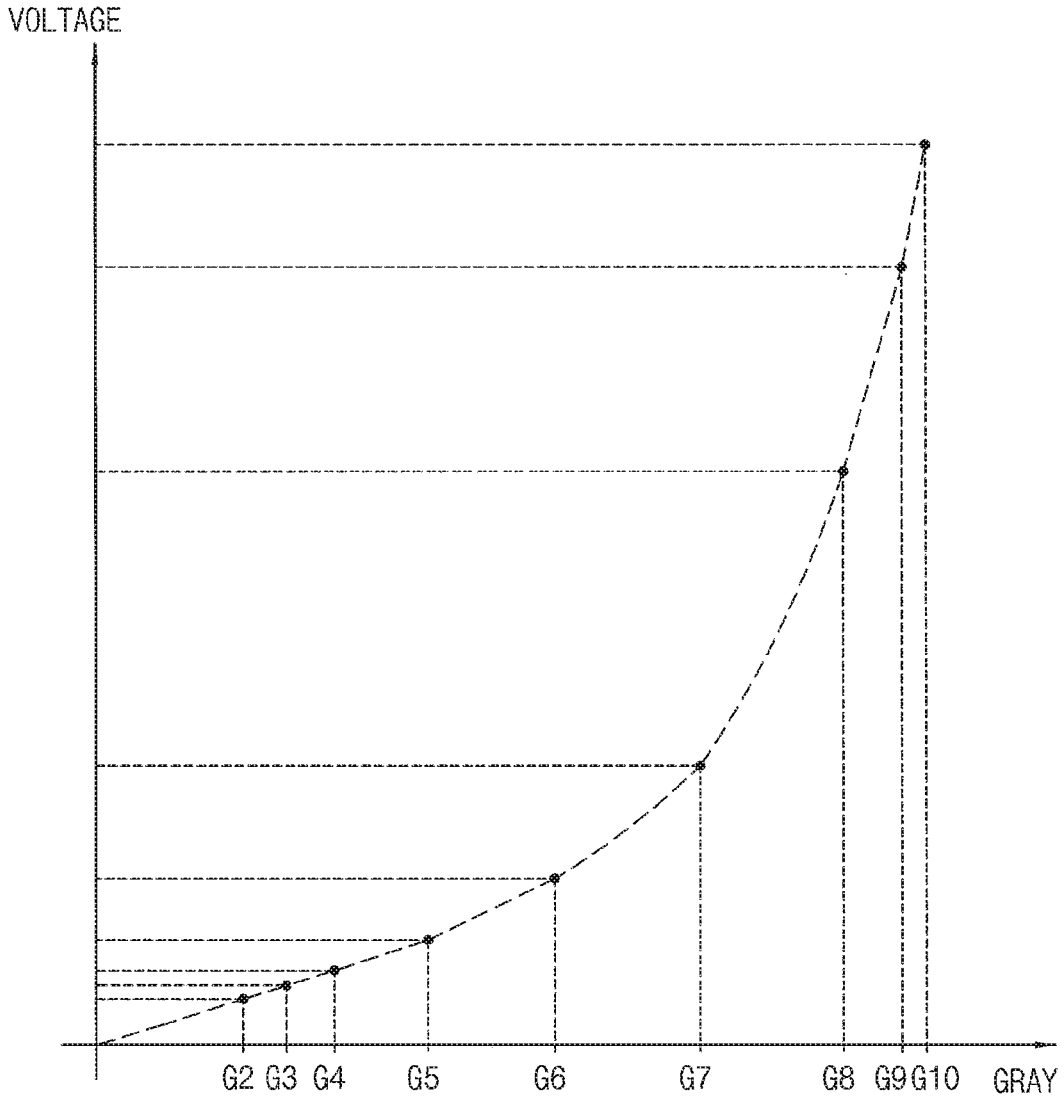
FIG. 4 is a graph illustrating a grayscale-voltage curve determined by a main compensator of FIG. 3.
Figure 5:
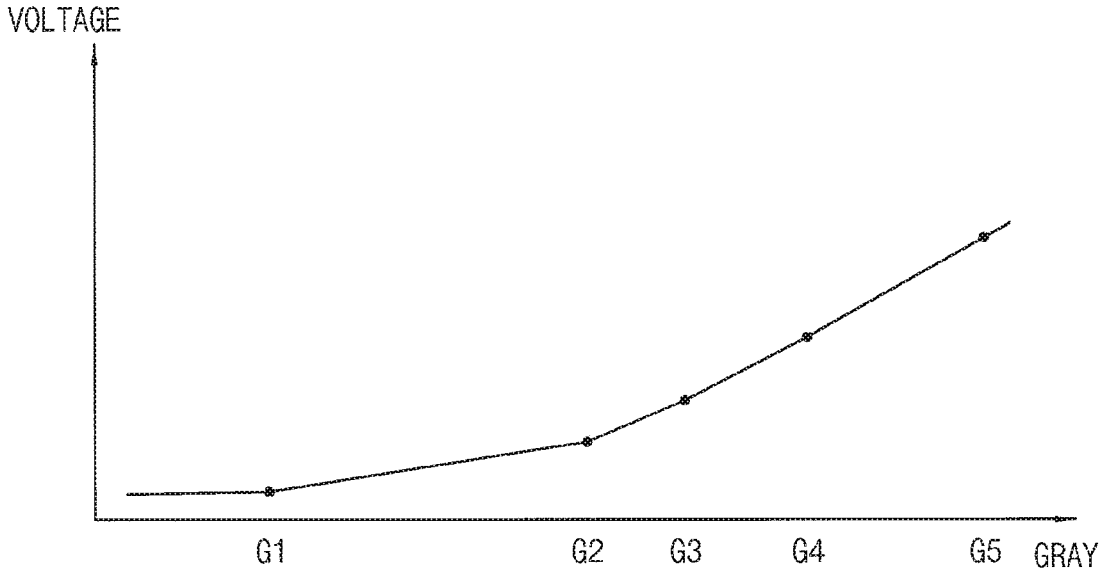
FIG. 5 is a graph illustrating a method of expecting a gamma voltage for a low grayscale by a low grayscale processor of FIG. 3.
Figure 6:
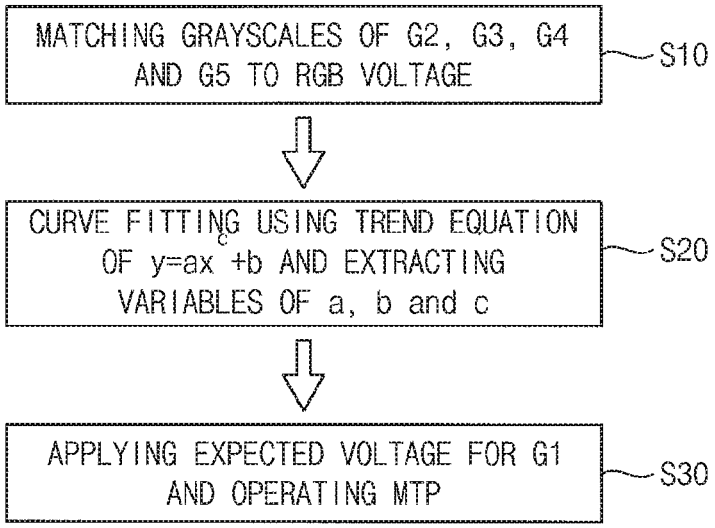
FIG. 6 is a flowchart illustrating an operation of the voltage compensator of FIG. 1.

FIG. 3 is a system block diagram illustrating the voltage compensator 400 of FIG. 1. FIG. 4 is a graph illustrating a grayscale-voltage curve determined by a main compensator 420 of FIG. 3. FIG. 5 is a graph illustrating a method of expecting a gamma voltage for a low grayscale by a low grayscale processor 444 of FIG. 3. FIG. 6 is a flowchart illustrating an operation of the voltage compensator 400 of FIG. 1.

Referring to FIGS. 1 to 3, the voltage compensator 400 may include the main compensator 420, an ACF (accurate curve fitting) compensator 440 and a color compensator 460.

The main compensator 420 may compensate a plurality of normal grayscale gamma voltages corresponding to a plurality of grayscale values based on measured luminances for the grayscale values equal to or greater than a reference grayscale. For example, the main compensator 420 may generate gamma voltage compensating values for some representative grayscale values. The gamma voltage compensating values for grayscale values between the adjacent representative grayscale values may be determined by an interpolation method. For example, when a maximum grayscale value is 255, the reference grayscale value may be 11.

In FIG. 4, the main compensator 420 may determine measured voltages corresponding to the measured luminances of a first representative grayscale value G2, a second representative grayscale value G3, a third representative grayscale value G4, a fourth representative grayscale value G5, a fifth representative grayscale value G6, a sixth representative grayscale value G7, a seventh representative grayscale value G8, an eighth ninth representative grayscale value G9 and a ninth representative grayscale value G10 based on the measured luminances of the representative grayscale values G2 to G10.

The ACF compensator 440 may expect a low grayscale gamma voltage (e.g. the gamma voltage of G1 in FIG. 5) based on the measured luminances (e.g. the measured luminances of G2 to G10) of the grayscale values equal to or greater than the reference grayscale value by the main compensator 420. The gamma voltage of the low grayscale value (e.g. G1 in FIG. 5) may be determined as the expected value instead of the measured value. For example, when the maximum grayscale value is 255, the low grayscale value (e.g. G1 in FIG. 5) may be 3 or 7.

The curve fitting part 442 may determine a grayscale-voltage curve based on the measured voltages for the first to ninth representative grayscale values G2 to G10 by the main compensator 420. The grayscale-voltage curve may be defined as following Equation 1.

$$y=ax^c+b \quad \text{[Equation 1]}$$

The curve fitting part 442 may determine variables a, b and c based on the measured voltages for the first to ninth representative grayscale values G2 to G10. The variables a, b and c may be determined using LMA (Levenberg Marquardt Algorithm) to solve a nonlinear minimum squares equation and Jackknife error algorithm.

In the present exemplary embodiment, the curve fitting part 442 may determine the variables a, b and c based on the measured voltages for least four grayscale values G2, G3, G4 and G5 among the first to ninth representative grayscale values G2 to G10. The least four grayscale values G2, G3, G4 and G5 among the first to ninth representative grayscale values G2 to G10 are used to determine the variables a, b and c so that accuracy of low grayscale value expectation may be enhanced.

As shown in FIG. 5, the low grayscale processor 444 expects the voltage of the low grayscale value G1 based on the grayscale-voltage curve generated using the variables a, b and c. The low grayscale processor 444 may use the gamma voltage LUT (lookup table) 446 to expect the voltage of the low grayscale value G1.

For example, the measured luminance by the sensor 600 may be a white luminance which is a mixed luminance of all primary colors. The measured voltage generated by the main compensator 420 may be a white measured voltage. The low grayscale gamma voltage expected by the low grayscale processor 444 may be a white low grayscale gamma voltage. To enhance accuracy of the compensation of the gamma voltage, the sensor 600 may measure luminance of each primary color (e.g. red, green and blue). However, to decrease the takt time of the manufacturing process, the sensor 600 may measure only the white luminance.

The ACF compensator 440 may determine a red low grayscale gamma voltage, a green low grayscale gamma voltage and a blue low grayscale gamma voltage based on the white low grayscale gamma voltage.

In FIG. 6, the main compensator 420 may determine the measured voltages based on the measured luminances of the first representative grayscale value G2, the second representative grayscale value G3, the third representative grayscale value G4 and the fourth representative grayscale value G5 (step S10). For example, the measured voltage may be the white measured voltage and the white measured voltage may be converted into the red measured voltage, the green measured voltage and the blue measured voltage.

The curve fitting part 442 operates the curve fitting using the trend equation of Equation 1. The variables a, b and c may be extracted based on the measured voltage of the first to fourth representative grayscale values G2, G3, G4 and G5 (step S20).

The low grayscale processor 444 may expect the low grayscale gamma voltage for the low grayscale value (e.g. G1) using the grayscale-voltage curve generated by the curve fitting part 442 (step S30).

The data driver 500 generates the data voltage based on the normal grayscale gamma voltage generated by the main compensator 420 and the low grayscale gamma voltage generated by the low grayscale processor 444 and outputs the data voltage to the display panel 100.

Figure 7:
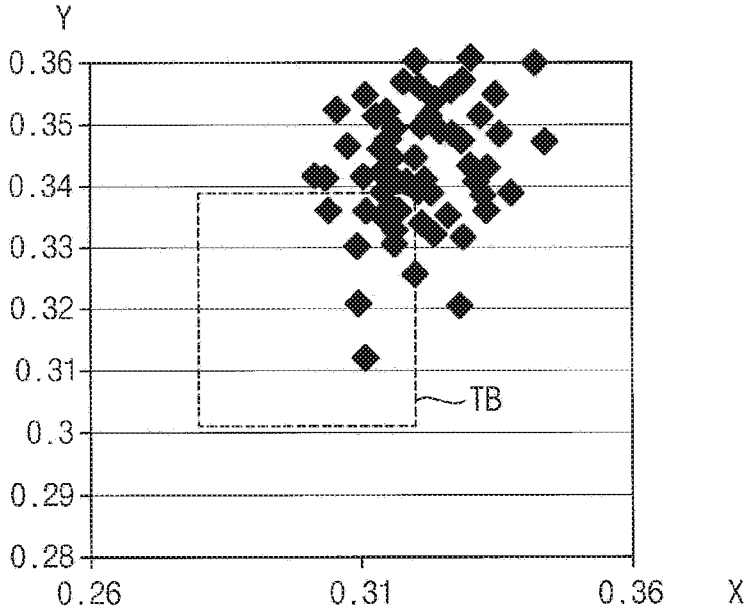
FIG. 7 is a graph illustrating an example of color coordinates of the image displayed using a low grayscale gamma voltage expected by the low grayscale processor of FIG. 3.
Figure 8:
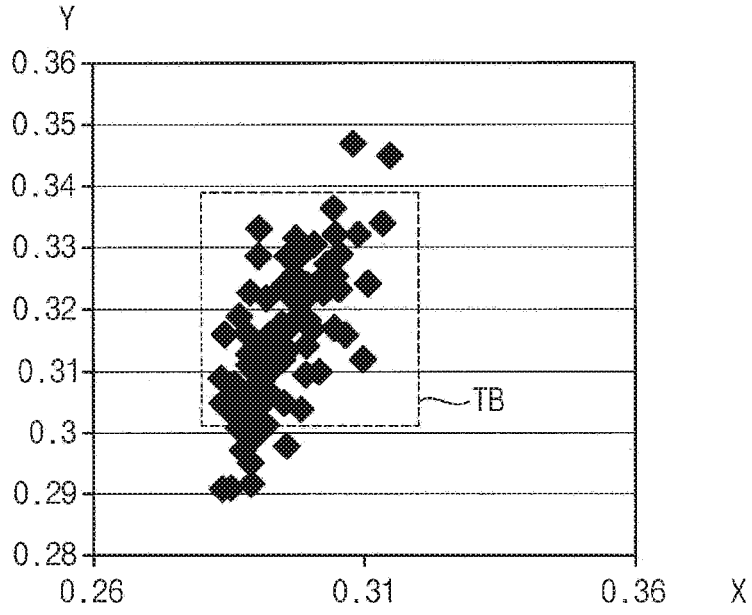
FIG. 8 is a graph illustrating an example of color coordinates of the image displayed after compensation by a color compensator of FIG. 3.

FIG. 7 is a graph illustrating an example of color coordinates of the image displayed using the low grayscale gamma voltage expected by the low grayscale processor 444 of FIG. 3. FIG. 8 is a graph illustrating an example of color coordinates of the image displayed after compensation by the color compensator 460 of FIG. 3.

Referring to FIGS. 1 to 8, when the image displayed on the display panel 100 by the low grayscale gamma voltage (e.g. the gamma voltage of G1) exceeds a target range of the color coordinate, the color compensator 460 may operate the color compensation to the low grayscale gamma voltage.

According to the method of ACF compensation explained referring to FIGS. 4 to 6, the sensor 600 measures the luminance of the white image, the low grayscale processor 444 expects the low grayscale gamma voltage based on the white grayscale-voltage curve so that the color coordinates of the display image may exceed the target range TB when only the method of ACF compensation is operated.

For example, the target range TB of the color coordinates may be $$0.28 \le x \le 0.32 \text{ and } 0.30 \le y \le 0.34$$

In FIG. 7, the image displayed using the low grayscale gamma voltage expected by the low grayscale processor 444 may exceed the target range TB of the color coordinates in a diagonal direction.

In FIG. 8, after the color compensator 460 operates the color compensation, most of the color coordinates of the display image shifted in the target range TB of the color coordinates.

The color compensator 460 may generate a color compensating value using differences between terminal values TRT, TGT and TBT of target color coordinates and terminal values TRM, TGM and TBM of measured color coordinates.

The color compensator 460 may generate new voltage register values NR(VR), NR(VG) and NR(VB) by adding the color compensating values to old voltage register values R(VR), R(VG) and R(VB) of the red gamma voltage, the green gamma voltage and the blue gamma voltage. The operation of the color compensator 460 may be represented as following Equation 2.

$$\begin{pmatrix} NR(VR) \\ NR(VG) \\ NR(VB) \end{pmatrix} = \begin{pmatrix} R(VR) \\ R(VG) \\ R(VB) \end{pmatrix} + \left[ \begin{pmatrix} TRT \\ TGT \\ TBT \end{pmatrix} - \begin{pmatrix} TRM \\ TGM \\ TBM \end{pmatrix} \right] \quad \text{[Equation 2]}$$

The color compensator 460 may generate index values of the measured color coordinates. The index values of the measured color coordinates may include a red index value, a green index value and a blue index value.

To determine the color compensating values, the luminance and the color coordinates may be converted into the red, green and blue index values. Converting constants to convert the luminance and the color coordinates into the red, green and blue index values may be determined using correlation between the sensor 600 and the display panel 100. The converting constants may vary according to element characteristics and device characteristics.

When the measured color coordinates are x and y, the luminance of the display image is L, the red index value of the measured color coordinates is IR, the green index value of the measured color coordinates is IG, the blue index value of the measured color coordinates is IB, the converting constants are C11, C12, C13, C21, C22, C23, C31, C32 and C33, the red index value IR and the green index value IG and the blue index value IB may be represented as following Equation 3.

$$\begin{pmatrix} IR \\ IG \\ IB \end{pmatrix} = \begin{pmatrix} C11 & C12 & C13 \\ C21 & C22 & C23 \\ C31 & C32 & C33 \end{pmatrix} \begin{pmatrix} x * L/y \\ L \\ -(L(x+y-1))/y \end{pmatrix} \quad \text{[Equation 3]}$$

When the terminal value of the measured color coordinates is T, the index value of the measured color coordinates is I and a gamma value of the display panel 100 is γ, the terminal value T and the index value I may have correlation defined by following Equation 4.

$$T = 1.055 \times \gamma\sqrt{I} - 0.055 \quad \text{[Equation 4]}$$

Although the color compensation is applied to the low grayscale gamma voltage when the image displayed on the display panel 100 by the low grayscale gamma voltage (e.g. the gamma voltage of G1) exceeds the target range of the color coordinate in the present exemplary embodiment, the present inventive concept is not limited thereto.

The color compensator 460 may be operated independently from the operation of the ACF compensator 440.

In this case, the voltage compensator 400 may compensate the plural gamma voltages corresponding to the plural grayscale values based on the measured luminances of the plural grayscale values. When the image displayed on the display panel 100 exceeds the target range of the color coordinate, the voltage compensator 400 may generate the color compensating value using the difference between the terminal value of the target color coordinates and the terminal value of the measured color coordinates.

Figure 9:
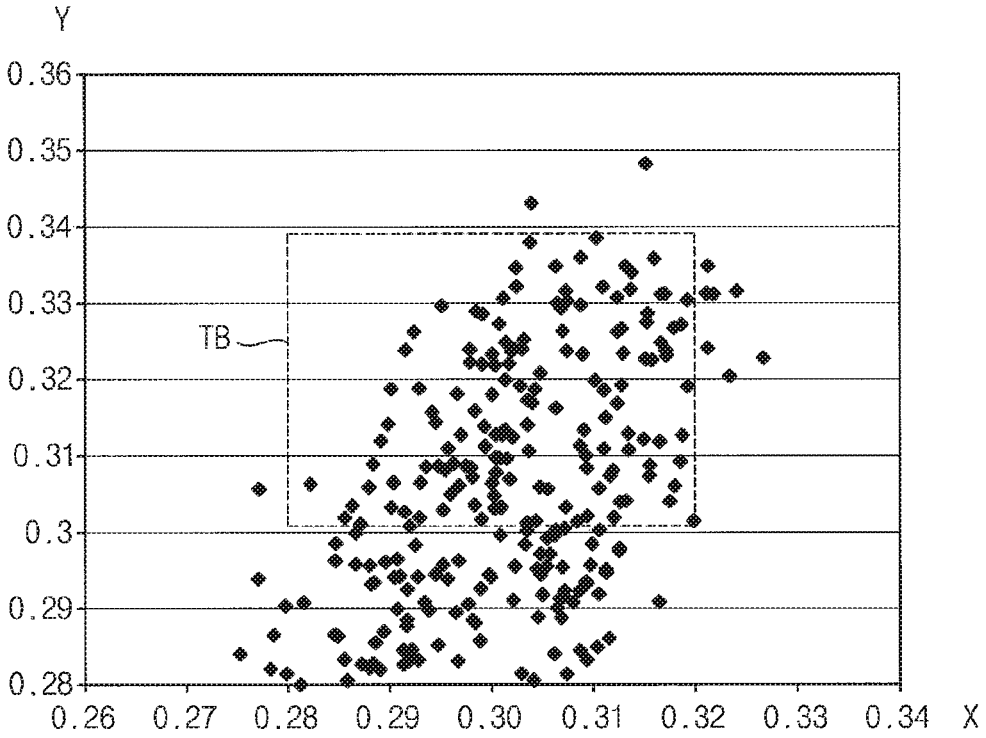
FIG. 9 (PRIOR ART)
FIG. 9 is a graph illustrating variation of low grayscale color coordinates according to compensation of a conventional voltage compensator.
Figure 10:
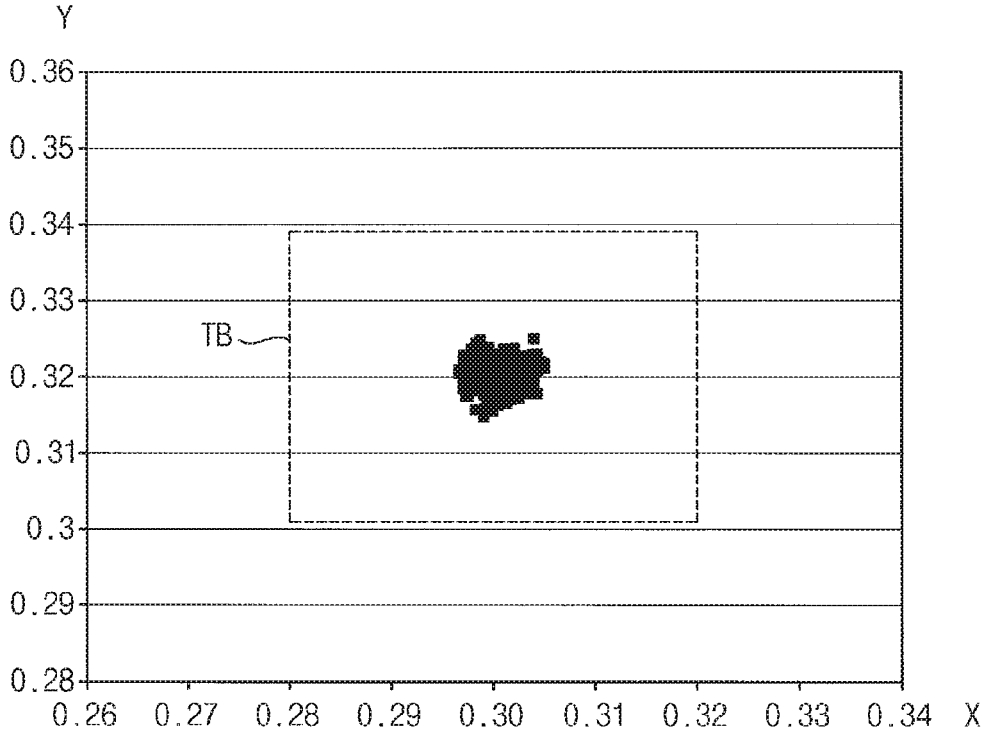
FIG. 10 is a graph illustrating variation of low grayscale color coordinates according to compensation of a voltage compensator according to an exemplary embodiment of the present inventive concept.

FIG. 9 is a graph illustrating variation of low grayscale value color coordinates according to compensation of a conventional voltage compensator. FIG. 10 is a graph illustrating variation of low grayscale value color coordinates according to compensation of the voltage compensator 400 according to an exemplary embodiment of the present inventive concept.

Referring to FIGS. 1 to 10, some of the color coordinates according to the compensation of the conventional voltage compensator are disposed in the target color coordinates TB and some of the color coordinates according to the compensation of the conventional voltage compensator are disposed out of the target color coordinates TB. All of the color coordinates according to the compensation of the voltage compensator 400 according to an exemplary embodiment of the present inventive concept are disposed in the target color coordinates TB. Herein, for example, the target color coordinates may be $0.28 \leq x \leq 0.32$ and $0.30 \leq y \leq 0.34$. The low grayscale value may be 7.

Figure 11:
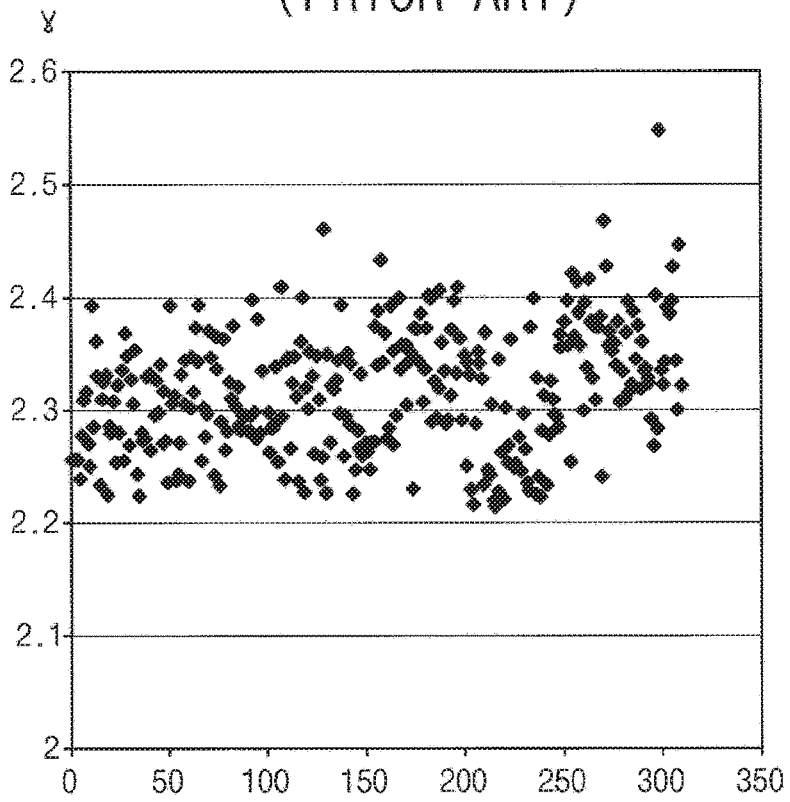
FIG. 11 (PRIOR ART)
FIG. 11 is a graph illustrating variation of low grayscale gamma values according to compensation of a conventional voltage compensator.
Figure 12:
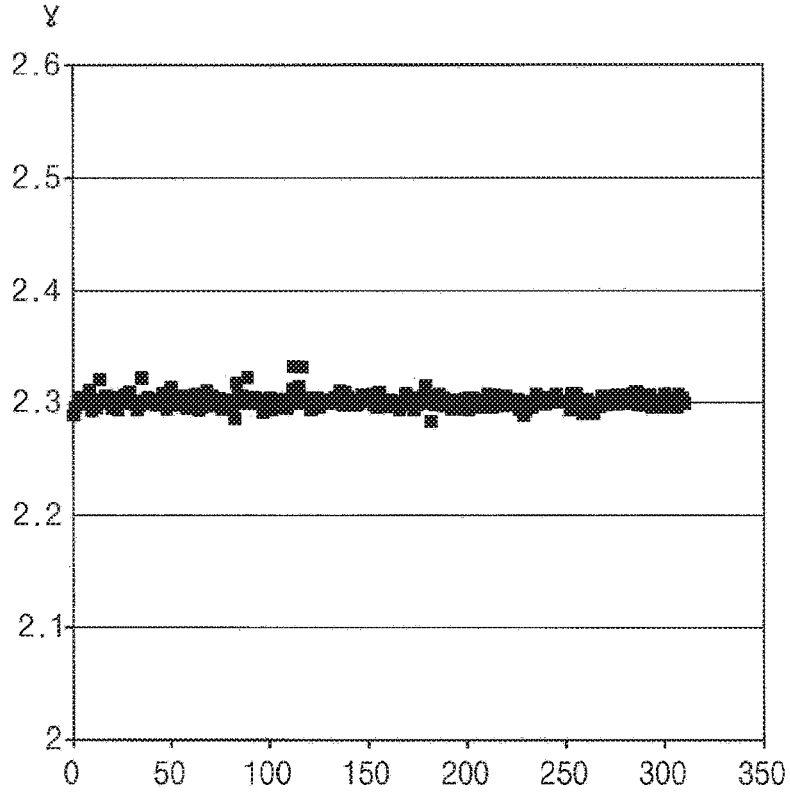
FIG. 12 is a graph illustrating variation of low grayscale gamma values according to compensation of a voltage compensator according to an exemplary embodiment of the present inventive concept.

FIG. 11 is a graph illustrating variation of low grayscale gamma values according to compensation of a conventional voltage compensator. FIG. 12 is a graph illustrating variation of low grayscale gamma values according to compensation of the voltage compensator 400 according to an exemplary embodiment of the present inventive concept.

In FIGS. 11 and 12, the target gamma value may be set to 2.3. Referring to FIGS. 1 to 12, the low grayscale gamma values according to compensation of a conventional voltage compensator are widely distributed between 2.2 and 2.6. The low grayscale gamma values according to compensation of the voltage compensator according to an exemplary embodiment of the present inventive concept are concentrated close to the target gamma value of 2.3. Herein, the low grayscale value is 7. Horizontal axis of FIGS. 11 and 12 represents the number of the measured products or the number of the measurements.

According to the present exemplary embodiment, the voltage compensator 400 expects the low grayscale gamma voltage less than the reference grayscale value based on the measured luminances for the grayscale values greater than the reference grayscale value. In addition, when the image displayed on the display panel 100 by the low grayscale gamma voltage exceeds the target range of the color coordinate, the voltage compensator 400 may operate the color compensation to the low grayscale gamma voltage. Thus, the display quality of the display panel 100 for the low grayscale value may be enhanced.

Furthermore, the takt time to determine the low grayscale gamma voltage may be dramatically decreased so that the productivity of the display apparatus may be enhanced.

According to the exemplary embodiments of the display apparatus, the method of compensating image of the display apparatus and the display image compensating system including the display apparatus, the display quality for the low grayscale value may be enhanced and the productivity of the display apparatus may be enhanced.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display apparatus comprising:

a display panel configured to display an image;

a voltage compensator configured to compensate a plurality of normal grayscale gamma voltages corresponding to a plurality of grayscale values equal to or greater than a reference voltage based on a plurality of measured luminances for the plurality of the grayscale values and to determine a low grayscale gamma voltage less than the reference voltage based on the measured luminances; and a data driver configured to generate a data voltage based on the normal grayscale gamma voltage and the low grayscale gamma voltage, and to output the data voltage to the display panel.

2. The display apparatus of claim 1, wherein the voltage compensator is configured to determine a measured voltage corresponding to the measured luminance, wherein the voltage compensator is configured to determine a grayscale-voltage curve based on the measured voltage, the grayscale-voltage curve being represented as a function of $y=ax^c+b$, and wherein the voltage compensator is configured to determine variables a, b and c based on the measured voltages for the plurality of the grayscale values to determine the low grayscale gamma voltage.

3. The display apparatus of claim 2, wherein the voltage compensator is configured to determine the variables a, b and c based on the measured voltages for least four grayscale values among the plurality of the grayscale values.

4. The display apparatus of claim 2, wherein the determined low grayscale gamma voltage is a white low grayscale gamma voltage, and wherein the voltage compensator is configured to determine a red low grayscale gamma voltage, a green low grayscale gamma voltage and a blue low grayscale gamma voltage based on the white low grayscale gamma voltage.

5. The display apparatus of claim 2, wherein the voltage compensator comprises a color compensator configured to apply a color compensation to the low grayscale gamma voltage when the image displayed on the display panel using the low grayscale gamma voltage exceeds a target range of color coordinates.

6. The display apparatus of claim 5, wherein the color compensator is configured to generate a color compensating value using a terminal value of target color coordinates and a terminal value of measured color coordinates.

7. The display apparatus of claim 6, wherein the color compensator is configured to generate an index value of the measured color coordinates, the index value including a red index value, a green index value and a blue index value, and wherein when the measured color coordinates are x and y, the luminance of the image is L, the red index value of the measured color coordinates is IR, the green index value of the measured color coordinates is IG, the blue index value of the measured color coordinates is IB and converting constants are C11, C12, C13, C21, C22, C23, C31, C32 and C33, the red index value and the green index value and the blue index value are represented as $$\begin{pmatrix} IR \\ IG \\ IB \end{pmatrix} = \begin{pmatrix} C11 & C12 & C13 \\ C21 & C22 & C23 \\ C31 & C32 & C33 \end{pmatrix} \begin{pmatrix} x * L/y \\ L \\ -(L(x+y-1))/y \end{pmatrix}.$$

8. The display apparatus of claim 7, wherein when a terminal value of the measured color coordinates is T, the index value of the measured color coordinates is I and a gamma value of the display panel is y, correlation between the terminal value of the measured color coordinates and the index value of the measured color coordinates is defined by $$T=1.055\times\sqrt[y]{I}-0.055.$$

9. A display apparatus comprising:

a display panel configured to display an image;

a voltage compensator configured to compensate a plurality of gamma voltages corresponding to a plurality of grayscale values based on a plurality of measured luminances for the plurality of the grayscale values; and a data driver configured to generate a data voltage based on the gamma voltage and to output the data voltage to the display panel, wherein the voltage compensator is configured to generate a color compensating value using a terminal value of target color coordinates and a terminal value of measured color coordinates when the image displayed on the display panel exceeds a target range of color coordinates.

10. The display apparatus of claim 9, wherein the voltage compensator is configured to generate an index value of the measured color coordinates, the index value including a red index value, a green index value and a blue index value, and wherein when the measured color coordinates are x and y, the luminance of the image is L, the red index value of the measured color coordinates is IR, the green index value of the measured color coordinates is IG, the blue index value of the measured color coordinates is IB and converting constants are C11, C12, C13, C21, C22, C23, C31, C32 and C33, the red index value and the green index value and the blue index value are represented as $$\begin{pmatrix} IR \\ IG \\ IB \end{pmatrix} = \begin{pmatrix} C11 & C12 & C13 \\ C21 & C22 & C23 \\ C31 & C32 & C33 \end{pmatrix} \begin{pmatrix} x * L/y \\ L \\ -(L(x+y-1))/y \end{pmatrix}.$$

11. The display apparatus of claim 10, wherein when a terminal value of the measured color coordinates is T, the index value of the measured color coordinates is I and a gamma value of the display panel is y, correlation between the terminal value of the measured color coordinates and the index value of the measured color coordinates is defined by $$T=1.055\times\sqrt[\gamma]{I}-0.055.$$

12. A method of compensating an image of a display apparatus, the method comprising:

compensating a plurality of normal grayscale gamma voltages corresponding to a plurality of grayscale values equal to or greater than a reference voltage based on a plurality of measured luminances for the plurality of the grayscale values;

determining a low grayscale gamma voltage less than the reference voltage based on the measured luminances; and generating a data voltage based on the normal grayscale gamma voltage and the low grayscale gamma voltage.

13. The method of claim 12, wherein the determining the low grayscale gamma voltage comprises:

determining a measured voltage corresponding to the measured luminance;

determining a grayscale-voltage curve based on the measured voltage, the grayscale-voltage curve being represented as a function of $y=ax^c+b$; and determining variables a, b and c based on the measured voltages for the plurality of the grayscale values.

14. The method of claim 13, wherein the variables a, b and c are determined based on the measured voltages for least four grayscale values among the plurality of the grayscale values.

15. The method of claim 13, wherein the determined low grayscale gamma voltage is a white low grayscale gamma voltage, and further comprising determining a red low grayscale gamma voltage, a green low grayscale gamma voltage and a blue low grayscale gamma voltage based on the white low grayscale gamma voltage.

16. The method of claim 13, further comprising applying a color compensation to the low grayscale gamma voltage when the image displayed on the display apparatus using the low grayscale gamma voltage exceeds a target range of color coordinates.

17. The method of claim 16, wherein the applying the color compensation to the low grayscale gamma voltage comprises generating a color compensating value using a terminal value of target color coordinates and a terminal value of measured color coordinates.

18. The method of claim 17, wherein the applying the color compensation to the low grayscale gamma voltage further comprises generating an index value of the measured color coordinates, the index value including a red index value, a green index value and a blue index value, and wherein when the measured color coordinates are x and y, the luminance of the image is L, the red index value of the measured color coordinates is IR, the green index value of the measured color coordinates is IG, the blue index value of the measured color coordinates is IB and converting constants are C11, C12, C13, C21, C22, C23, C31, C32 and C33, the red index value and the green index value and the blue index value are represented as $$\begin{pmatrix} IR \\ IG \\ IB \end{pmatrix} = \begin{pmatrix} C11 & C12 & C13 \\ C21 & C22 & C23 \\ C31 & C32 & C33 \end{pmatrix} \begin{pmatrix} x * L/y \\ L \\ -(L(x+y-1))/y \end{pmatrix}.$$

19. A display image compensating system comprising:

a display panel configured to display an image;

a sensor configured to measure a luminance of the image of the display panel;

a voltage compensator configured to compensate a plurality of normal grayscale gamma voltages corresponding to a plurality of grayscale values equal to or greater than a reference voltage based on a plurality of the measured luminances for the plurality of the grayscale values and to determine a low grayscale gamma voltage less than the reference voltage based on the measured luminances;

a data driver configured to generate a data voltage based on the normal grayscale gamma voltage and the low grayscale gamma voltage and to output the data voltage to the display panel; and a sensor driver configured to drive the sensor and to transmit the measured luminance by the sensor to the voltage compensator.

20. The display image compensating system of claim 19, wherein the voltage compensator is configured to:

determine a measured voltage corresponding to the measured luminance;

determine a grayscale-voltage curve based on the measured voltage, the grayscale-voltage curve being represented as a function of $y=ax^c+b$, and determine variables a, b and c based on the measured voltages for the plurality of the grayscale values to determine the low grayscale gamma voltage.

* * * * *